US005660197A

United States Patent [19]

Boe et al.

[11] Patent Number: 5,660,197

[45] Date of Patent: Aug. 26, 1997

[54] TENT WITH INTEGRATED, INFLATABLE MATTRESS

[76] Inventors: Cynthia Ann Boe; Ronald Haakon Boe, both of 2465 Virginia, North Bend, Oreg. 97459-2121

[21] Appl. No.: 585,728

[22] Filed: Jan. 16, 1996

[51] Int. Cl.[6] ..... E04H 15/20

[52] U.S. Cl. ..... 135/116; 52/2.11; 52/2.17; 135/96; 135/97; 135/124; 135/137

[58] Field of Search ..... 52/2.11, 2.13, 52/2.17, 2.22; 135/96, 124, 116, 125, 97, 137, 95

[56] References Cited

U.S. PATENT DOCUMENTS

| | | | |
|---|---|---|---|
| D. 327,524 | 6/1992 | Kim | D21/253 |
| 2,656,844 | 10/1953 | Kreuzer | 135/1 |
| 2,918,683 | 12/1959 | Kaplan | 5/343 |
| 3,840,919 | 10/1974 | Middleton | 5/343 |
| 4,000,585 | 1/1977 | Denaro | 52/2.18 X |
| 4,000,749 | 1/1977 | Busco | 52/2.17 X |
| 4,590,956 | 5/1986 | Griesenbeck | 135/119 X |
| 4,607,655 | 8/1986 | Wagner | 135/95 X |
| 5,007,212 | 4/1991 | Fritts et al. | 52/2.18 X |
| 5,226,261 | 7/1993 | Wilbourn et al. | 52/2.21 |
| 5,247,768 | 9/1993 | Russo | 52/2.17 X |
| 5,375,902 | 12/1994 | Church | 296/169 |
| 5,487,400 | 1/1996 | Dawkins | 135/87 X |
| 5,502,927 | 4/1996 | Hammerton | 52/2.13 X |

FOREIGN PATENT DOCUMENTS

| | | | |
|---|---|---|---|
| 197712 | 5/1976 | Switzerland | 135/116 |

*Primary Examiner*—Wynn E. Wood
*Attorney, Agent, or Firm*—John D. Gugliotta; David L. Volk

[57] ABSTRACT

A portable tent is disclosed having an outer sidewall supported by a pair of flexible, plastic support poles. A double cushioned floor aligns the bottom of the tent, and is permanently seamed around the perimeter of the tent. An integral, inflatable air mattress is formed between the cushioned floor and a mattress upper surface, defining an air-tight, internal volume. On the exterior of the tent is at least one inflation valve.

2 Claims, 2 Drawing Sheets

TENT WITH INTEGRATED, INFLATABLE MATTRESS

BACKGROUND OF THE INVENTION

1. Field of the Invention

The present invention relates generally to tents and, more particularly, to a portable, collapsible tent having an integrated, inflatable mattress.

2. Description of the Related Art

As is well-known in the art, many tents and tent related combinations are known. For example, in U.S. Pat. No. 3,840,919, issued in the name of Middleton, a combined sleeping bag and inflatable tent is disclosed having an inflatably supported tent structure with a sleeping bag formed in combination with the tent floor.

Also known is U.S. Pat. No. 2,656,844, issued in the name of Kreuzer, in which a combined sleeping bag and tent is disclosed in which a sleeping bag is modified to function somewhat as a small tent.

While numerous other attempts at improved tents have been made, none provide for comfortable sleeping arrangements that allow a user to remain dry from morning dew, or merely moisture seeping into the tent enclosure. A need has therefore been felt for an improved but less complex tent which is easy to erect, comfortable to sleep in, remains portable and collapsible, and provides a dry, comfortable sleeping surface.

SUMMARY OF THE INVENTION

It is therefore a primary object of the present invention to provide an improved camping type portable tent which incorporates an inflatable air mattress integrally within the tent floor.

Briefly described according to one embodiment of the present invention, a tent is provided similar to that conventionally available, having an outer sidewall and a pair of flexible, plastic support poles for supporting the tent. In accordance with a preferred embodiment, a double cushioned floor aligns the bottom of the tent, and is permanently seamed around the perimeter of the tent. An integral, inflatable air mattress is formed between the cushioned floor and a mattress surface, defining an air-tight, internal volume. On the exterior of the tent are two inflation valves, similar to those on large capacity rubber rafts.

The preferred embodiment of the present invention provides an improved but less complex tent which is easy to erect, comfortable to sleep in, remains portable and collapsible, and provides a dry, comfortable sleeping surface.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

1. Detailed Description of the Figures

Figure 1:
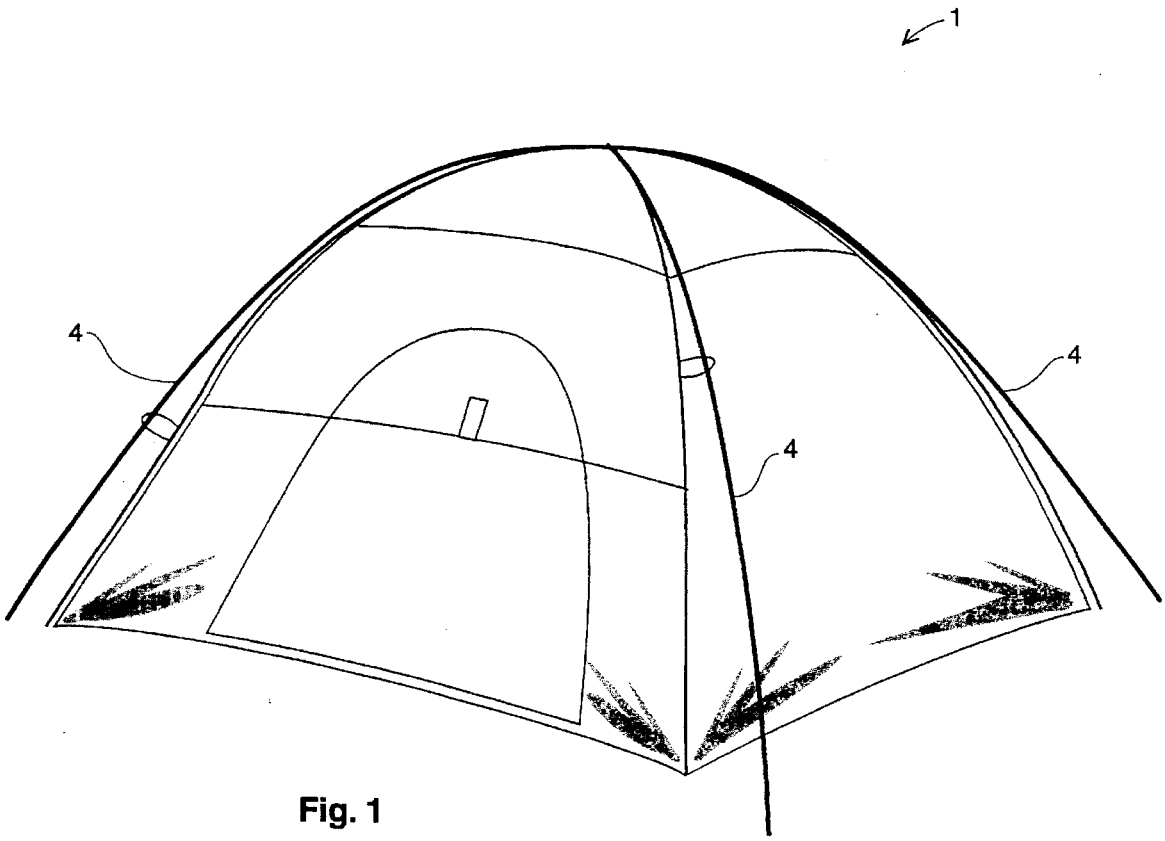
FIG. 1 is a perspective view of a tent according to the preferred embodiment of the present invention.
Figure 2:
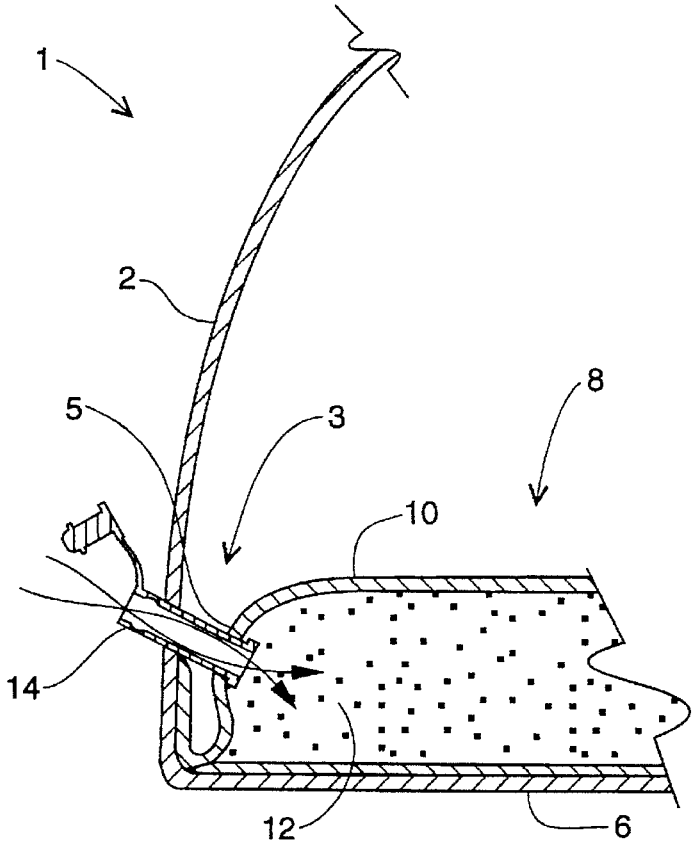
FIG. 2 is a partial cross sectional view of the tent floor in an inflated condition.
Figure 3:
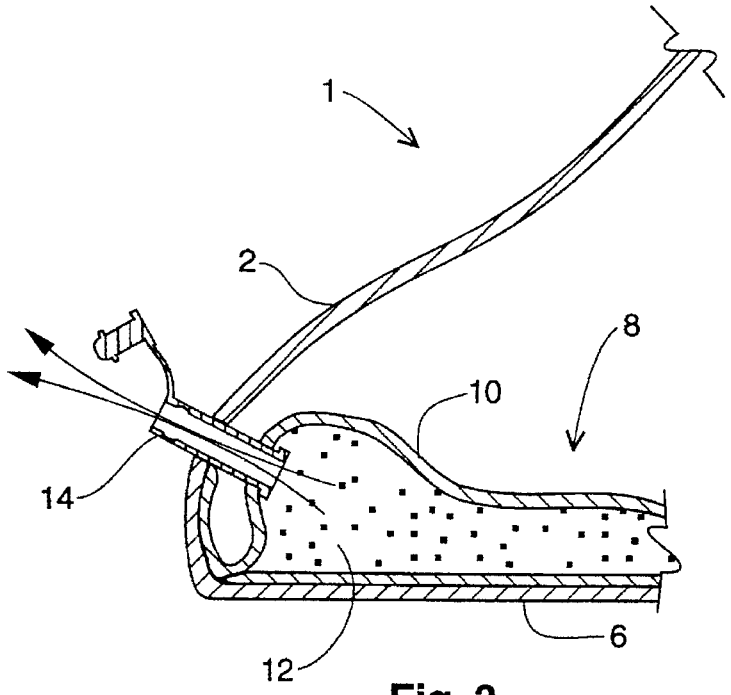
FIG. 3 is a partial cross sectional view of the tent floor in a deflated condition.

Referring now to the figures, a portable tent 1 is shown, according to the present invention, having a tent similar to that conventionally available, with an outer sidewall 2 supported by a pair of flexible, plastic support poles 4. In accordance with a preferred embodiment, a double cushioned floor 6 aligns the bottom of the tent, and is permanently seamed around the perimeter of the tent. An integral, inflatable air mattress 8 is formed between the cushioned floor 6 and a mattress upper surface 10, defining an air-tight, internal volume 12. On the exterior of the tent is at least one inflation valve 14, similar to those on large capacity rubber rafts.

The mattress upper surface 10 is connected to the floor 6 and the sidewall 2 proximate the intersection of the floor 6 and the sidewall 2 such that a gap 3 exists between sides 5 of the mattress 8 and the sidewall 2 when the sidewall 2 is supported by the support poles 4 in a conventional manner as stated previously herein and the mattress 8 is inflated.

2. Operation of the Preferred Embodiment

To use the present invention, a user would unfold it and lay it on the ground where desired. The support poles 4 are bent and inserted outside the tent 1 as would be done with a conventional tent, forming an "X" at the pinnacle and thereby supporting the tent 1 via the tension from the bent poles 4. The air mattress 8 is then inflated in a conventional manner, such as by an air pump, such as a compressor, bicycle pump, double action hand pump, or by repeatedly exhaling into the inflation valves. To tear down the tent 1, the poles 4 are removed and the mattress 8 deflated, rendering the tent 1 ready to be folded and transported.

The foregoing description is included to illustrate the operation of the preferred embodiment and is not meant to limit the scope of the invention. As one skilled in the pertinent art could device based upon this disclosure, many types and styles of tents can be improved in much the same manner. Therefore, the scope of the invention is to be limited only by the following claims.

What is claimed is:

1. A portable tent comprising:

a non-inflatable outer sidewall forming an outer perimeter;

a pair of flexible, support poles for supporting said outer sidewall in a conventional manner from outside of said outer sidewall;

a double cushioned floor aligning the bottom of the tent, said floor being permanently seamed around the perimeter of the tent;

integral, inflatable air mattress formed between the cushioned floor and a mattress upper surface, said mattress defining an air-tight, internal volume;

said mattress having sides when inflated;

said mattress upper surface connected to said floor and said sidewall proximate the intersection of said floor and said sidewall such that a gap exists between said sides of said mattress and said sidewall when said sidewall is supported by said support poles in said conventional manner and said mattress is inflated; and at least one inflation valve in fluid communication with said internal volume for introduction of air to and release of air from said air mattress, wherein said inflation valves are accessible from outside said outer sidewall.

2. The tent as described in claim 1, wherein said mattress is formed of a rubberized material having the property of resisting water penetration.

* * * * *